US005875576A

United States Patent [19]

Kram et al.

[11] Patent Number: 5,875,576

[45] Date of Patent: Mar. 2, 1999

[54] METHOD AND DISPLAY CARD FOR LABELING A TOOL

[75] Inventors: Robert J. Kram, Muskego; Randall J. Wright, Hartland, both of Wis.

[73] Assignee: Empire Level Mfg. Corp., Milwaukee, Wis.

[21] Appl. No.: 883,837

[22] Filed: Jun. 27, 1997

[51] Int. Cl.[6] ..... G09F 3/00; G09F 1/04

[52] U.S. Cl. ..... 40/299.01; 40/672; 40/124.09; 40/661.08

[58] Field of Search ..... 40/672, 124.09, 40/299.01, 661.03, 661.08, 5

[56] References Cited

U.S. PATENT DOCUMENTS

| | | | |
|---|---|---|---|
| 1,824,794 | 9/1931 | Rohlfes | 40/5 |
| 3,227,268 | 1/1966 | Gringer | 40/672 X |
| 4,512,092 | 4/1985 | McLaughlin et al. | 40/672 X |

*Primary Examiner*—Brian K. Green
*Assistant Examiner*—Robert G. Santos
*Attorney, Agent, or Firm*—Jansson, Shupe, Bridge & Munger, Ltd.

[57] ABSTRACT

A new method for labeling an elongate tool comprising the steps of providing a tool having (a) a pair of first and second placard retention edges, and (b) at least one support surface extending along the length of the tool. A display card has first and second placard edges opposite one another. A pair of retention fold lines are formed on the card and a pair of support surface boundary fold lines are formed between the retention fold lines. The card is folded along the boundary fold lines, thereby forming a spine panel. The spine panel is placed against the tool support surface and each placard edge is engaged with a separate first placard retention edge. The retention fold lines are then pressed into engagement with respective second placard retention edges, thereby affixing the card to the tool. A new display placard for labeling tools and the like is also disclosed.

14 Claims, 7 Drawing Sheets

METHOD AND DISPLAY CARD FOR LABELING A TOOL

FIELD OF THE INVENTION

This invention relates generally to product labeling and more particularly to labeling an elongated product such as a builder's tool.

BACKGROUND OF THE INVENTION

At least at the over-the-counter retail level, product labeling is a necessary function of commerce. When labeling a product, it is mandatory that labeling be achieved in a way that the sales person is able to ascertain the product price, either visually or by using Universal Product Code (UPC) bars and appropriate bar "reading" equipment. Typically, computerized equipment capable of reading UPC bars also automatically adjusts inventory so that store personnel can quickly be apprised of the remaining stock, if any. And, preferably, it is also helpful if the label explains how to use the product. But many product labels bear no instruction for use.

One problem associated with certain types of product labeling includes defacing of a product surface as a result of the means, e.g., high-bond adhesive, used to attach the label. Product defacing associated with labeling can be avoided through the use of a low-bond adhesive that allows for easy removal. Although the use of such easily removable labels overcomes problems dealing with product appearance, it creates a new problem in that such labels can be easily and surreptitiously changed using a label from another product. Such changing of labels is known as "price swapping" and is undertaken by unscrupulous purchasers for the purpose of obtaining a lower price.

Another problem that arises in the labeling of certain products involves the need to include (or at least the desirability of including) operating instructions on the label. Certain products are packaged in a manner that does not allow for the inclusion of an operating manual or instruction sheet. Or the manufacturer simply elects to forego the expense (and resulting cost to the consumer) of elaborate packages containing instruction sheets or the like. When no packaging is included with the product and when operating instructions are desirable, the historic practice has been to apply an adhesive instructional label to the product outer surface. But such instructional labeling is attended by one of the disadvantages noted above, defacing or price-swapping, depending upon whether the label is permanent or readily removed.

An improved method and display card for labeling products that overcomes shortcomings associated with current product labeling would be a distinct advance in the art.

OBJECTS OF THE INVENTION

An object of the invention is to provide an improved display card and method for labeling a product that overcomes some of the problems and shortcomings of the prior art.

Another object of the invention is to provide an improved display card and method for labeling a product that makes it more difficult to engage in price swapping.

Still another object of the invention is to provide an improved display card and method for labeling a product that does not require the use of any adhesives.

Still another object of the invention is to provide an improved display card and method for labeling a product that permits the inclusion of instructions while yet avoiding interfering with the use of the product.

Yet another object of the invention is to provide an improved display card and method for labeling a product that does not mar or deface the surface of the product. How these and other objects are accomplished will become apparent from the following descriptions and from the drawings.

SUMMARY OF THE INVENTION

Because of the nature of the invention, this summary necessarily includes a tool, a tool-labeling display card and a number of edges, surfaces, and fold lines on the tool, the card or both. Understanding of each of these details is aided by an analysis at the beginning of the Detailed Description below.

The invention involves a method for labeling an elongated tool such as a builder's level commonly used by carpenters and the like. The method comprises the steps of: (1) providing a tool having (a) a pair of first and second placard retention edges, and (b) at least one support surface extending along the length of the tool; (2) supplying a display card having first and second placard edges opposite one another; (3) forming on the card a pair of retention fold lines and a pair of support surface boundary fold lines positioned between the retention fold lines; (4) folding the display card along the boundary fold lines, thereby forming a spine panel in the display card; (5) placing the spine panel against the support surface; (6) engaging each placard edge with a separate first placard retention edge; and (7) pressing the retention fold lines into engagement with respective second placard retention edges, thereby affixing the card to the tool.

The new method results in a labeled tool wherein the display card "hugs" the cross-sectional contour of the tool. The card is easily removed following sale and price swapping is not likely to occur since it will be immediately visually apparent that the special card "contour-fits" a particular tool—and does not fit another tool.

In a preferred embodiment of the invention, the distance between the first and second pairs of placard retention edges is less than the distance between the placard edges and the retention fold lines. In another embodiment of the invention, these two distances are equal. In both of these embodiments, the placard edges of the display card rest against the first pair of placard retention edges.

In yet another preferred embodiment of the invention, the tool has a pair of grooves and each of the placard retention edges is in a respective one of the grooves. The grooves may be wide or narrow and in an optimum configuration, each groove is V-shaped and narrows to an apex. Each placard retention edge is positioned in a respective apex.

While the display card fold lines may be formed using perforations, partial cuts or the like, a highly preferred display card has fold lines formed by compression scoring, i.e., by compressing the card along the respective fold lines so that the card folds more easily along such lines than elsewhere. Another aspect of the invention is described with respect to several fold lines on the card and each type of fold line is differently named in the description which follows.

The pair of retention fold lines constitute first and second retention fold lines, the pair of boundary fold lines constitute first and second boundary fold lines, the forming step includes forming a first intermediate fold line between the first boundary fold line and the first retention fold line and forming a second intermediate fold line between the second boundary fold line and the second retention fold line. In this embodiment, the pressing step is followed by the step of folding the display card along the intermediate fold lines. In a more specific embodiment of the invention, the intermediate fold lines are adjacent to the support surface when the card is mounted on the tool.

In still another preferred embodiment, the support surface is bounded by a first edge having a width and the first boundary fold line and the first intermediate fold line are spaced by a dimension substantially equal to the width. The support surface is also bounded by a second edge having a width and the second boundary fold line and the second intermediate fold line are spaced by a dimension substantially equal to the width of the second edge.

Practicing the method results in a display card which is affixed to the tool. A highly preferred card has an outwardly-facing surface that includes a plurality of pictogram instructions for using the tool.

In other specific aspects of the invention, the tool support surface extends along the length of the tool and such support surface has a certain width. Each of a pair of spaced edges has a width, is contiguous with the surface and extends angularly thereto. The tool also includes a pair of panel surfaces. Each such surface has a width and extends between a respective one of a pair of placard retention edges and the support surface.

The display card has a pair of edges and a pair of boundary fold lines positioned between the placard edges and spaced from each other by a dimension about equal to the tool surface width noted above. A first intermediate fold line is between the first boundary fold line and the first placard edge and is spaced from the first boundary fold line by a dimension about equal to the width of the spaced edge. A first retention fold line is between the first intermediate fold line and the first placard edge and is spaced from the first placard edge by a dimension about equal to the width of each of the panel surfaces mentioned above.

In a more specific version of the highly preferred embodiment, the placard also includes a second intermediate fold line between the second boundary fold line and the second placard edge. The second intermediate fold line is spaced from the second boundary fold line by a dimension that is about equal to the width of either spaced-apart edge of the tool support surface. A second retention fold line is located between the second intermediate fold line and the second placard edge. Such second retention fold line is spaced from the second placard edge by a dimension about equal to the width of the one of the tool's two panel surfaces.

Other details of the invention are disclosed in the following detailed description and in the drawings.

DETAILED DESCRIPTION OF PREFERRED EMBODIMENTS

Figure 1:
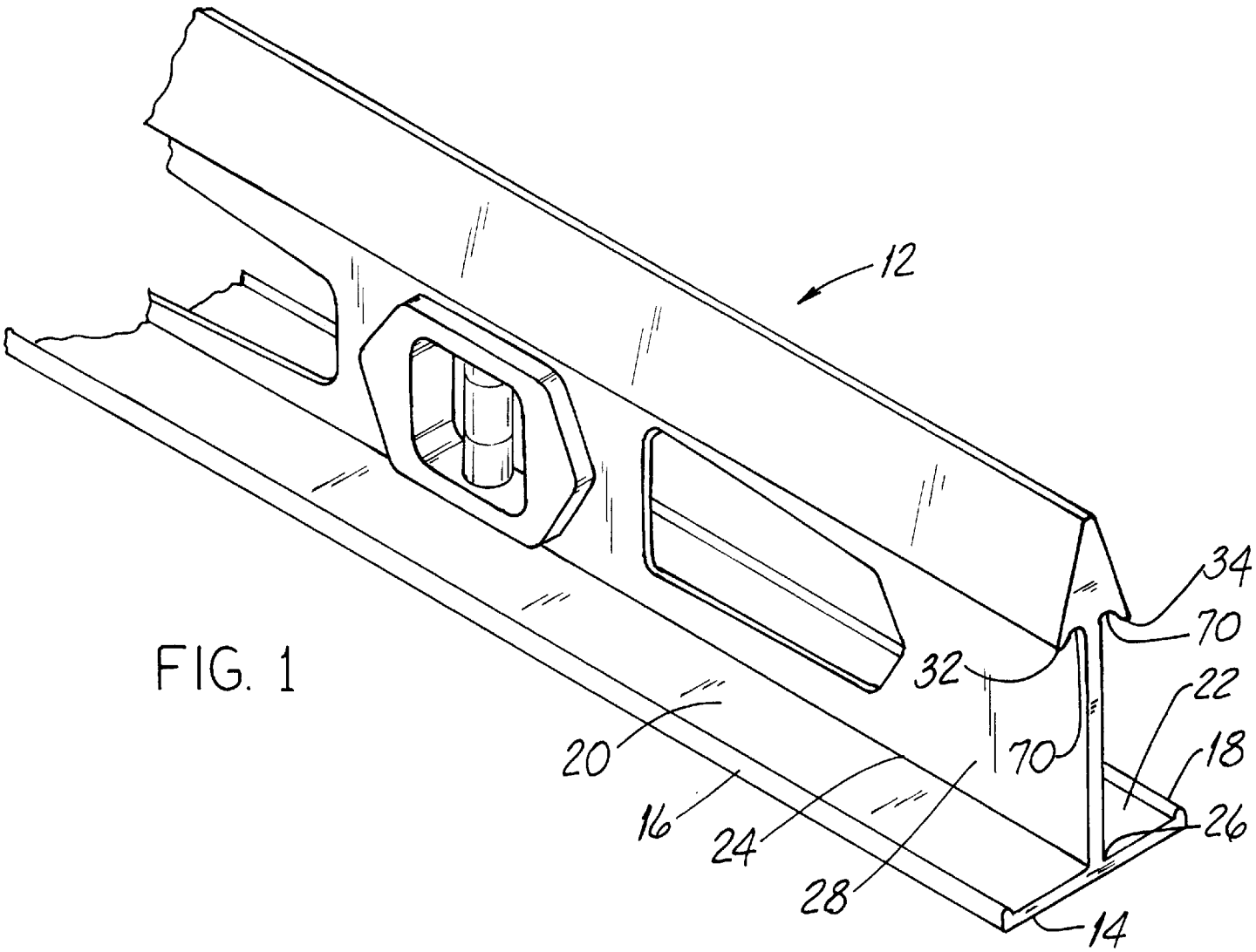
FIG. 1 is a perspective view of a particular version of the tool involved with the invention.
Figure 2:
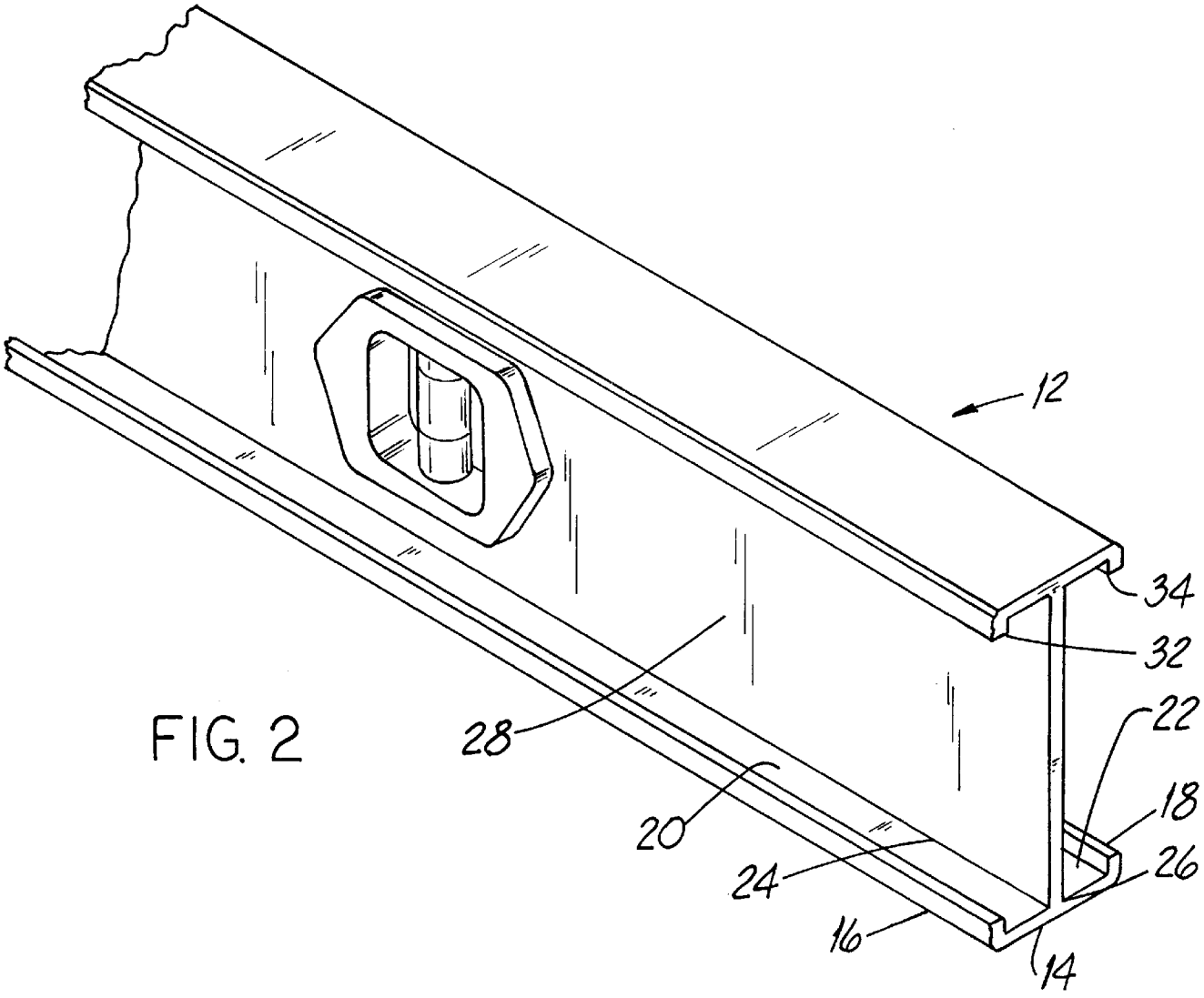
FIG. 2 is a perspective view of a second version of the tool involved with the invention, said tool having an I-beam type cross-section.

Before describing the inventive method and display card 10, it will be helpful to first establish the terminology used to identify different features of the tool 12 and the card 10. Referring first to FIG. 1, an exemplary tool 12*a* is a combination level, yard stick and meter stick made by Empire Level Mfg. Corp., Milwaukee, Wis., a leading manufacturer of builder's tools. Another exemplary tool 12*b*, shown in FIG. 2, is a different type of builder's level, also made by Empire Level Mfg. Corp.

Each tool 12 includes a support surface 14 upon which the tool 12 conveniently rests upright when not in use. The support surface 14 is bounded by first and second edges 16, 18 which are spaced from one another and contiguous with the support surface 14.

First and second rib surfaces 20, 22, respectively, extend between the first and second edges 16, 18, respectively, and placard retention edges 24, 26. Elsewhere in this specification, the placard retention edges 24, 26 are each referred to as a "second" placard retention edge.

First and second panel surfaces 28, 30, respectively, extend generally vertically between the placard retention edges 24, 32, respectively, and the placard retention edges 26, 34, respectively. Elsewhere in this specification, each of the placard retention edges 32, 34 is referred to as a "first" placard retention edge.

Figure 3:
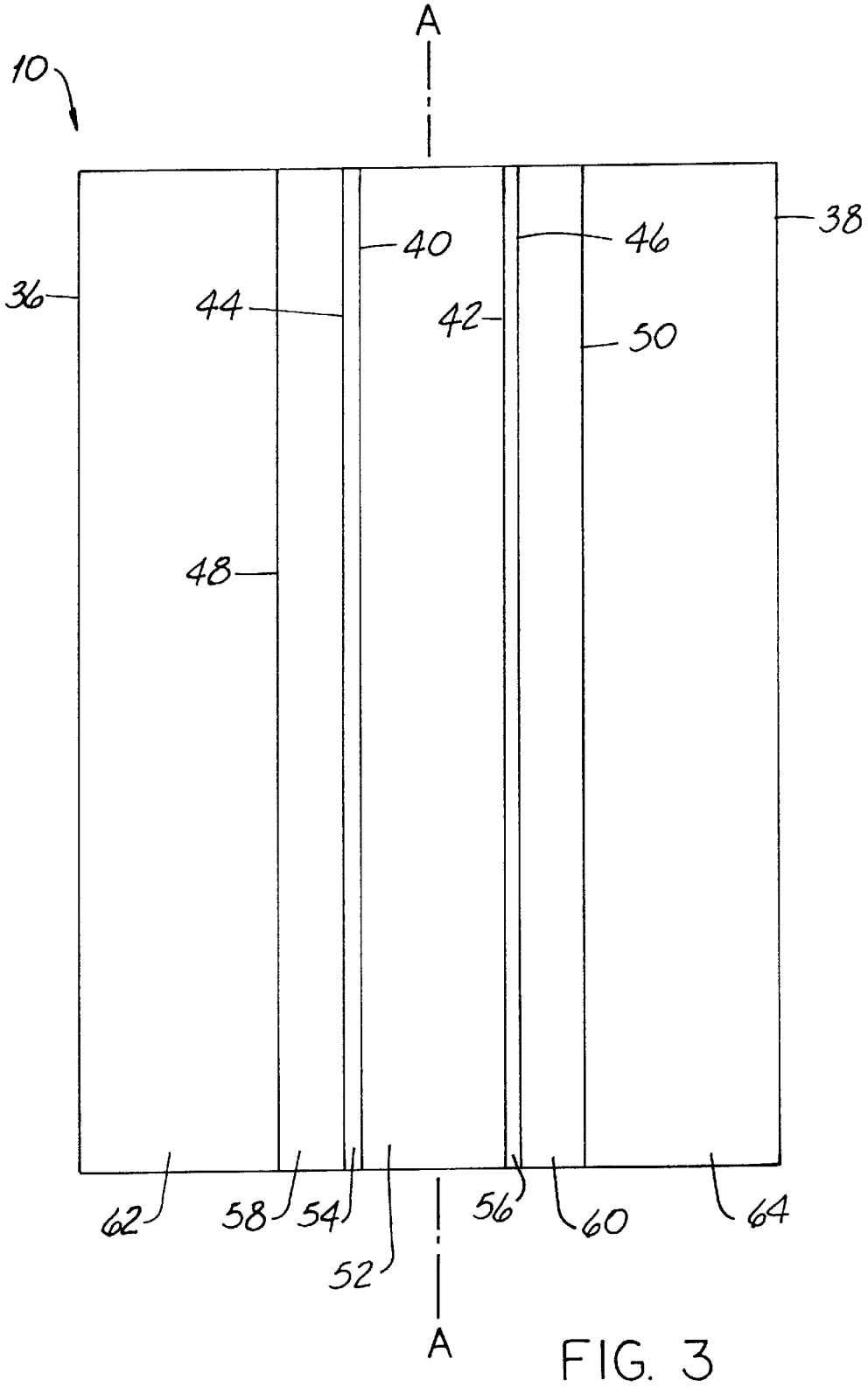
FIG. 3 is a top view of the display card involved with the invention showing the various fold lines scored on the face of the card.

Referring next to FIG. 3, terminology used to identify features of the card 10 will now be set forth. As to orientation of the card 10 to the tool 12, the card 10 extends along an axis A—A which is parallel to the long support surface 14 when the card 10 is mounted on the tool 12. All of the fold lines and both of the placard edges 36, 38 described below are parallel to the axis.

The card has first and second boundary fold lines 40, 42, respectively, which are spaced by a dimension substantially equal to the lateral dimension of the tool support surface 14. First and second intermediate fold lines 44, 46, respectively, are spaced laterally outwardly from the boundary fold lines 40, 42, respectively, and the dimension between each intermediate fold line 44, 46 and its most-closely-adjacent boundary fold line 40, 42, respectively, is substantially equal to the vertical dimension of each edge 16 and 18.

First and second retention fold lines 48, 50 respectively, are positioned laterally outwardly of the intermediate fold lines 44, 46. Such first and second retention fold lines 48, 50 are between the intermediate fold lines 44, 46, respectively, and the first and second placard edges 36, 38, respectively. The fold lines and the placard edges 36, 38 may be said to demark the card 10 into a support portion 52, first and second edge portions 54, 56, respectively, first and second rib portions 58, 60, respectively, and first and second panel portions 62, 64, respectively.

Figure 4:
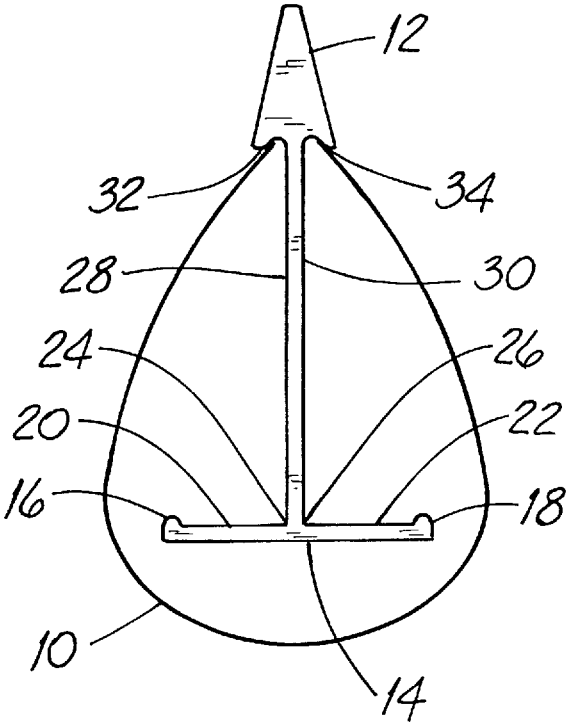
FIG. 4 is an end view of the tool involved with the invention showing the display card folded around the support surface of the tool and placard edges of the display card inserted in the placard retention edges of the tool.
Figure 5:
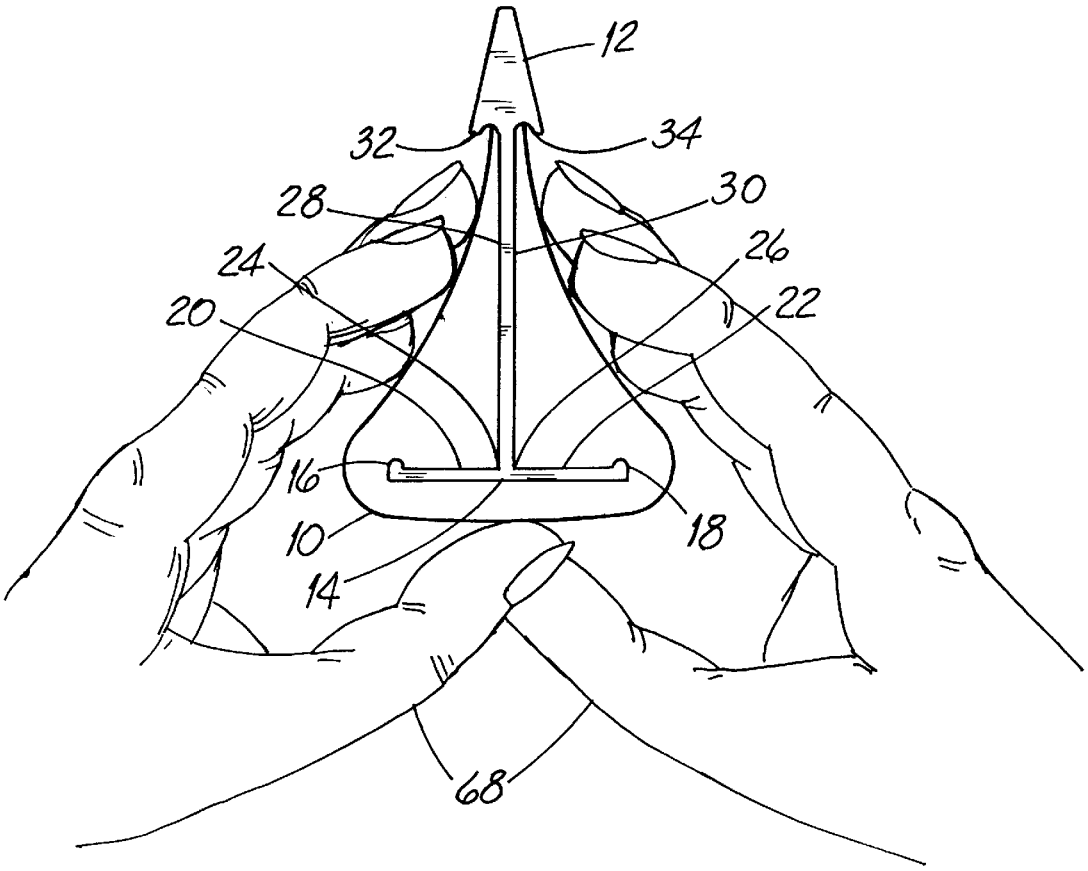
FIG. 5 is an end view of the tool involved with the invention showing the display card folded around the support surface of the tool, the placard edges of the display card inserted in the placard retention edges of the tool and a pair of hands pressing the display card against the panel surfaces of the tool.

Referring now to FIGS. 4 and 5, the invention involves a display card 10 and method for labeling a product such as either of the illustrated tools 12*a*, 12*b*. The method comprises the steps of: (1) providing a tool 12 having (a) a pair of first and second placard retention edges 24, 26, 32 and 34 and (b) at least one support surface 14 extending along the length of the tool 12; (2) supplying a display card 10 having first and second placard edges 36, 38 opposite one another; (3) forming on the card 10 a pair of retention fold lines 48, 50 and a pair of support surface boundary fold lines 40, 42 positioned between the retention fold lines 48, 50; (4) engaging each placard edge 36, 38 with a separate first placard retention edge 32, 34; (5) folding the display card 10 along the boundary fold lines 40, 42 thereby forming a spine panel 52 in the display card 10; and (6) placing the spine panel 52 against the support surface 14. Substantially simultaneously with steps (5) and (6), the retention fold lines 48, 50 are pressed into engagement with respective second placard retention edges 24, 26 thereby affixing the card 10 to the tool 12.

When manually mounting the card 10 to the tool 12 beginning with step (4) described above, it is convenient to cup the hands 68 facing toward one another and in a manner to grasp the tool 12 and the card 10 between the hands 68 as generally shown in FIG. 5. After the placard edges 36, 38 are engaged with the respective placard retention edges 32, 34 the hands 68 are urged toward one another to form the card 10 closely around the tool 12 as shown in FIG. 5 and to "snap" the retention fold lines 48, 50 into engagement with respective second placard retention edges 24, 26. Stating it another way, urging the hands 68 toward one another "toggles" the card 10 and particularly the card first and second rib portions 58, 60 and first and second panel portions 62, 64 toward and against the tool 12 first and second rib surfaces 20, 22, respectively, and first and second panel surfaces 28, 30, respectively.

The new method results in a labeled tool 12 wherein the display card 10 "hugs" the cross-sectional contour of the tool 12. Labels attached using this method are free of fasteners, adhesives or the like. Marring and defacing of tool surfaces are thereby avoided. Although the display card 10 used with this method is easily removed following sale of the product, price swapping is not likely to occur since it will be immediately visually apparent that the special card "contour-fits" a particular tool—and does not fit another tool.

Figure 6:
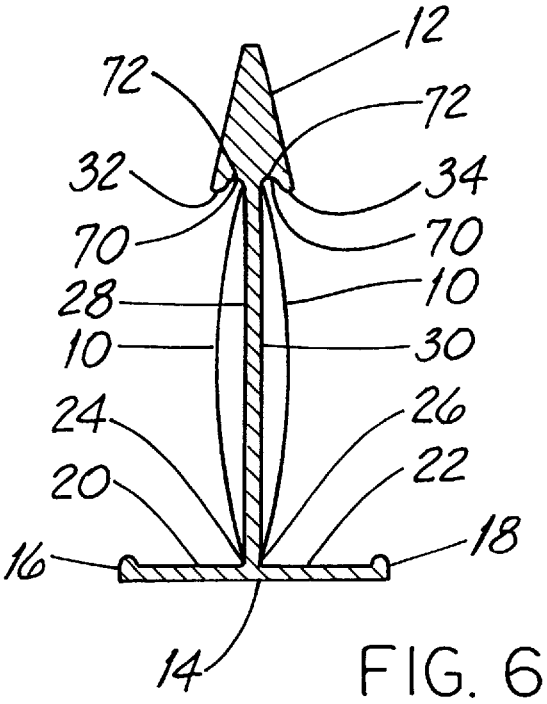
FIG. 6 is a cross-sectional view of a particular version of the tool used in the invention.
Figure 7:
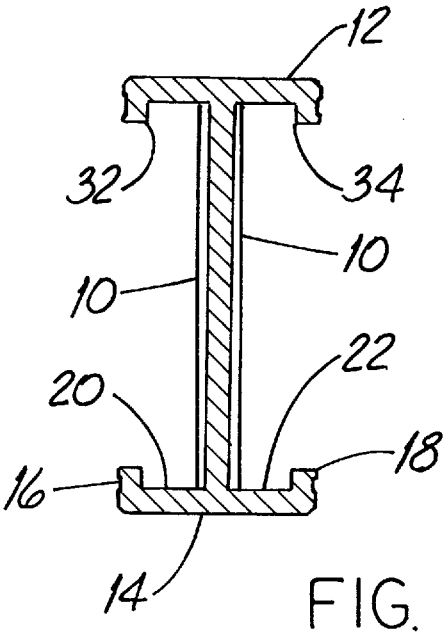
FIG. 7 is a cross-sectional view of a second version of the tool used in the invention.

In a preferred embodiment of the invention, as shown in FIG. 6, the distance between the first 32, 34 and second 24, 26 pairs of placard retention edges is less than the distance between the placard edges 36, 38 and the retention fold lines 48, 50. This dimensional relationship results in a display card 10 that is slightly bowed along the surface of the tool 12. FIG. 7 shows another embodiment of the invention in which these two distances are equal thus allowing the card 10 to lay flat against the tool 12. In both of these embodiments, the placard edges 36, 38 of the display card 10 rest against the first pair of placard retention edges 32, 34.

In yet another preferred embodiment of the invention, the tool 10 has a pair of grooves 70 and each of the placard retention edges 32, 34 is in a respective one of the grooves 70. FIG. 6 shows an optimum configuration in which each groove 70 has an apex 72 and each retention edge 36, 38 is positioned in a respective apex 72.

While the display card 10 fold lines may be formed using perforations, partial cuts or the like, a highly preferred display card 10 has fold lines formed by compression scoring, i.e., by compressing the card 10 along the respective fold lines so that the card 10 folds more easily along such lines than elsewhere. Another aspect of the invention is described with respect to several fold lines on the card 10.

Referring again to FIG. 5, the pressing step is followed by the step of folding the display card 10 along the intermediate fold lines 44, 46. In a more specific embodiment of the invention the intermediate fold lines 44, 46 are adjacent to the support surface 14.

Figure 8:
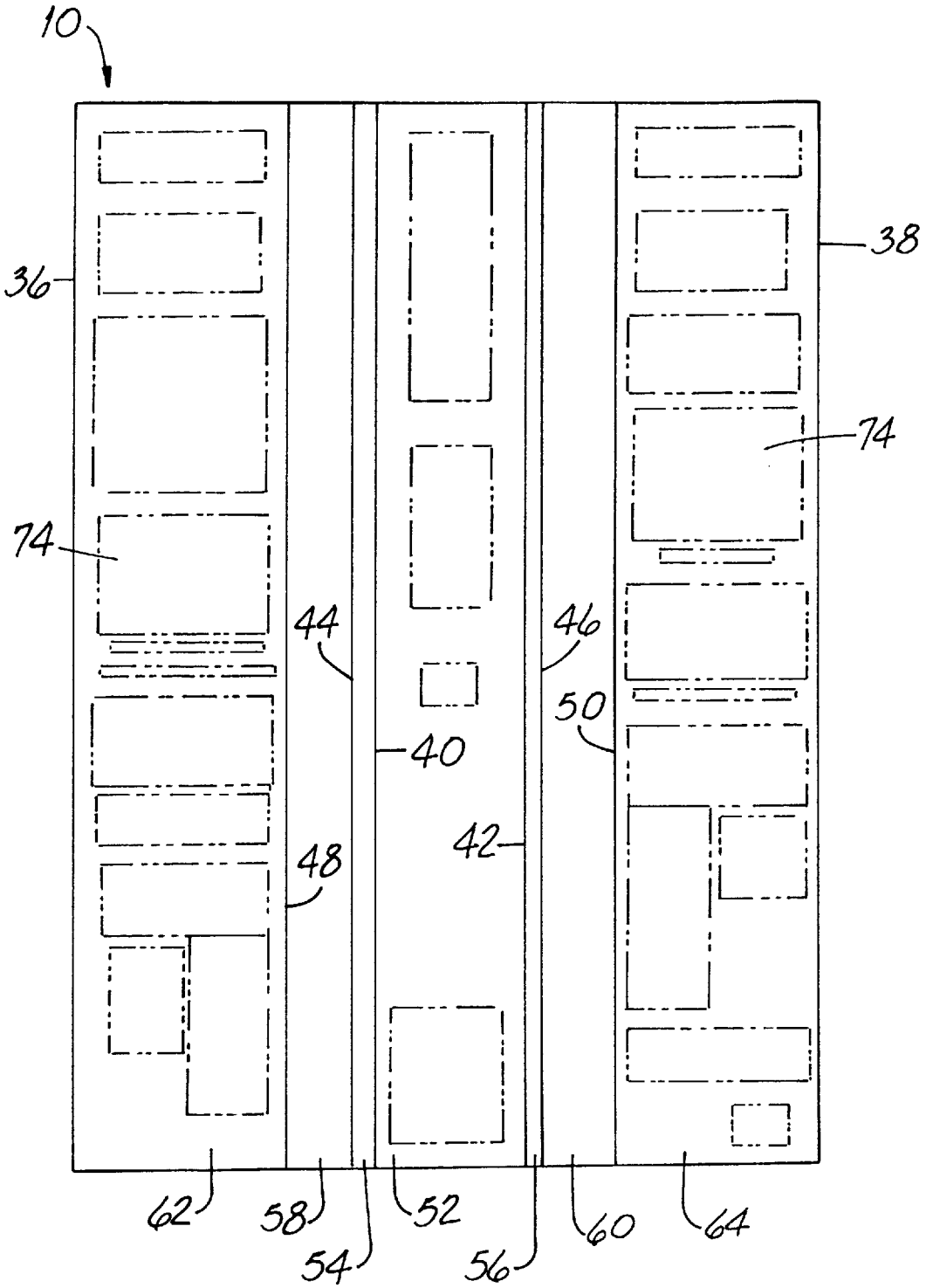
FIG. 8 is a top view of the display card involved with the invention showing the various fold lines scored on the face of the card and outlines of the pictogram instructions imprinted on the card.

Practicing the method results in a display card 10 which is affixed to the tool 12. Referring also to FIG. 8, a highly preferred card 10 has an outwardly-facing surface that includes a plurality of pictogram 74 instructions for using the tool 12. Such instructions 74 may be written in one or more languages depending upon where the product is to be sold.

While the principles of the invention have been shown and described in connection with specific embodiments, it is to be understood clearly that such embodiments are by way of example and are not limiting.

What is claimed:

1. A method for labeling an elongate builder's level prior to sale, the method comprising the steps of:

providing a level having (a) a pair of first placard retention edges and a pair of second placard retention edges, (b) at least one level support surface extending along the length of the tool, and (c) first and second panel surfaces extending away from the support surface;

supplying a display card having first and second placard edges opposite one another;

forming on the card first and second retention fold lines and first and second support surface boundary fold lines positioned between the retention fold lines, the forming step thereby defining a first panel portion between the first placard edge and the first retention fold line and thereby defining a second panel portion between the second placard edge and the second retention fold line;

engaging each placard edge with a respective placard retention edge that forms one of the first pair of placard retention edges on the level;

folding the display card along the boundary fold lines, thereby forming a spine panel in the display card;

placing the spine panel against the support surface;

urging the first and second panel portions toward the first and second panel surfaces, respectively;

pressing the retention fold lines into engagement with a respective one of the edges that forms the second pair of placard retention edges, thereby affixing the card to the level by engagement of the card with the level.

2. The method of claim 1 wherein:

one of the first placard retention edges and a corresponding one of the second placard retention edges are spaced by a first dimension;

one of the placard edges and a corresponding one of the retention fold lines are spaced by a second dimension;

the second dimension is greater than the first dimension; and one of the panel portions is thereby bowed outwardly away from the level.

3. The method of claim 1 wherein:

one of the first placard retention edges and a corresponding one of the second placard retention edges are spaced by a first dimension;

one of the placard edges and a corresponding one of the retention fold lines are spaced by a second dimension; and the second dimension is equal to the first dimension.

4. The method of claim 1 wherein the first and second placard edges of the display card retentively bear against a respective one of the first pair of placard retention edges.

5. The method of claim 2 wherein:

the level has a pair of grooves; and each edge of the first pair of placard retention edges is in card-retaining engagement with a respective one of the grooves.

6. The method of claim 5 wherein:

each groove has an apex; and each edge of the first pair of placard retention edges is positioned in a respective apex.

7. The method of claim 1 wherein:

the forming step includes forming a first intermediate fold line between the first boundary fold line and the first retention fold line and forming a second intermediate fold line between the second boundary fold line and the second retention fold line; and the pressing step is followed by the step of folding the display card along the intermediate fold lines.

8. The method of claim 7 wherein the intermediate fold lines are adjacent to the support surface.

9. The method of claim 7 wherein the support surface is bounded by a first edge having a width and the first boundary fold line and the first intermediate fold line are spaced by a dimension substantially equal to the width.

10. The method of claim 9 wherein the support surface is bounded by a second edge having a width and the second boundary fold line and the second intermediate fold line are spaced by a dimension substantially equal to the width of the second edge.

11. The method of claim 1 wherein:

when the display card is affixed to the level, such display card has an outwardly-facing surface; and the surface includes a plurality of pictogram instructions for using the level.

12. The method of claim 1 wherein compression scoring is used to form the fold lines.

13. In combination, an elongate builder's measuring tool and a display placard mounted on the tool, and wherein the tool includes:

a level support surface extending therealong and having a surface width;

a pair of spaced edges contiguous with the support surface and extending angularly thereto, each edge having an edge width; and a pair of panel surfaces positioned between the spaced edges, each panel surface extending between a respective one of a pair of placard retention edges and the support surface, each panel surface having a panel width; and wherein the placard includes:

first and second placard edges;

first and second boundary fold lines between the placard edges and spaced by a dimension about equal to the surface width;

a first intermediate fold line between the first boundary fold line and the first placard edge and spaced from the first boundary fold line by a dimension about equal to the edge width; and a first retention fold line between the first intermediate fold line and the first placard edge and spaced from the first intermediate fold line by a dimension about equal to the panel width;

and wherein:

each of the placard edges engages a respective one of the pair of placard retention edges;

the placard has a support portion against the tool support surface and a respective separate panel portion against each of the panel surfaces;

the support surface is substantially perpendicular to the panel surfaces; and the panel surfaces are substantially parallel to one another.

14. The combination of claim 13 wherein the placard also includes:

a second intermediate fold line between the second boundary fold line and the second placard edge and spaced from the second boundary fold line by a dimension about equal to the edge width; and a second retention fold line between the second intermediate fold line and the second placard edge and spaced from the second intermediate fold line by a dimension about equal to the panel width.

* * * * *